US008107651B2

(12) United States Patent
Liou et al.

(10) Patent No.: US 8,107,651 B2
(45) Date of Patent: Jan. 31, 2012

(54) SPEAKER STRUCTURE

(75) Inventors: Chang-Ho Liou, Changhua County (TW); Ming-Daw Chen, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 800 days.

(21) Appl. No.: 12/187,381

(22) Filed: Aug. 7, 2008

(65) Prior Publication Data

US 2009/0060234 A1 Mar. 5, 2009

(30) Foreign Application Priority Data

Sep. 4, 2007 (TW) ..... 96132878 A

(51) Int. Cl.
*H04R 25/00* (2006.01)

(52) U.S. Cl. ..... 381/191; 381/150

(58) Field of Classification Search ..... 381/150, 381/191, 399, 164, 431, 386
See application file for complete search history.

(56) References Cited

U.S. PATENT DOCUMENTS 2,855,467 A 10/1958 Curry
3,894,199 A 7/1975 Tamura et al.
6,483,924 B1 11/2002 Kirjavainen
2007/0098207 A1* 5/2007 Lin ..... 381/399
2009/0016552 A1 1/2009 Medley et al.
2009/0060233 A1* 3/2009 Liou et al. ..... 381/191

FOREIGN PATENT DOCUMENTS

JP 60-046196 3/1985
JP 2009-117888 5/2009

OTHER PUBLICATIONS

M. Paajanen et al., "ElectroMechanical Film (EMFi)—a new multipurpose electret material", Sensors and Actuators A, vol. 84, pp. 95-102, 2000.
E. Saarimäki et al., "Novel Heat Durable Electromechanical Film: Processing for Electromechanical and Electret Applications", IEEE Transactions on Dielectrics and Electrical Insulation vol. 13, No. 5, pp. 963-972, 2006.

* cited by examiner

*Primary Examiner* — Walter L Lindsay, Jr.
(74) *Attorney, Agent, or Firm* — Jianq Chyun IP Office

(57) ABSTRACT

A speaker structure including a single electret vibrating film structure, a single metal electrode with a plurality of holes and a frame supporting member is provided. In an example, the electret vibrating film structure is formed by an electret film layer, an ultra-thin metal thin film electrode and an isolation layer stacked together, in which the ultra-thin metal thin film electrode is located between the electret film layer and the isolation layer. In another example, the electret vibrating film structure is formed by the electret film layer and a conductive electrode layer having oxide conductive materials. The frame supporting member is located between the electret vibrating film structure and the metal electrode for forming a space for the vibration of the electret vibrating film structure, so as to generate sounds.

27 Claims, 3 Drawing Sheets

SPEAKER STRUCTURE

CROSS-REFERENCE TO RELATED APPLICATION

This application claims the priority benefit of Taiwan application serial no. 96132878, filed on Sep. 4, 2007. The entirety of the above-mentioned patent application is hereby incorporated by reference herein and made a part of this specification.

BACKGROUND OF THE INVENTION

1. Field of the Invention

The present invention relates to a speaker structure. More particularly, the present invention relates to a speaker structure designed through using ferroelectric amount of the vibrating film.

2. Description of Related Art

Generally, vision and audition are two most direct senses for human-beings, so for a long time, scientists try their best to develop various relevant systems capable of reproducing vision and audition. Recently, as the increasing of people's demands on the sensing quality, and under a precondition that 3C products (computer, communication, and consumer electronics) have been developed towards the trend of being short, small, light, and thin, a power-saving, light, thin speaker designed according to ergonomics demand will have a great number of demands and applications in the near further, no matter it is matched with a large-size flat panel speaker, or used as small earphone for walkman, and stereophonic mobile phone.

Driving manners for electrostatic speaker may be approximately divided into three types, namely, dynamic, piezoelectric, and electrostatic. Recently, the dynamic speaker has been most widely used, and its technology is most mature. However, due to the disadvantages of the original architecture, it is impossible to be flattened in volume. Therefore, facing the challenge of the trend that the 3C product becomes light and thin and the home theater becomes flattened, it is impossible for the dynamic speaker to satisfy the market trend.

The piezoelectric speaker uses the piezoelectric effect of the piezoelectric material, and utilizes the material deformation characteristics of the piezoelectric material caused by the electric field to push the vibration film to generate sounds. Although the structure of the speaker is flattened and miniaturized, it has disadvantages of significant distortion and unstable, and it is difficult to satisfy the standard of the audition enjoyment required by the current people.

The electrostatic speaker is mainly Hi-end earphone and loudspeaker on the current market. The operating principle for the conventional electrostatic speaker is that two fixed electrode plates with holes are used to clamp a conductive vibrating film to form a capacitor, and then a DC bias is applied to the vibrating film and an AC voltage is applied to two fixed electrodes, and electrostatic force generated by the positive and negative electric fields is used to drive the conductive vibrating film to vibrate and to radiate sounds. The bias of the conventional electrostatic speaker must reach up to hundreds or even thousands of volts, so it is required to externally connect to an amplifier with a high unit price and a large volume, which is the reason that it cannot be popularized.

As for the electrostatic speaker, for example, in U.S. Pat. No. 3,894,199, an electro-acoustic transducer structure is mainly provided, as shown in FIG. 1. It includes two fixed electrode structures 110 and 120 placed on two sides. The fixed electrode structures 110 and 120 have a plurality of pores for scattering the generated sounds. A vibrating film 130 is disposed between the fixed electrode structures 110 and 120. A fixing structure 140 is made of an insulation material, and used to fix the fixed electrode structures 110 and 120 and the vibrating film 130. The fixed electrode structures 110 and 120 are respectively connected to an AC source 160 through a transformer 150. When an AC signal is transmitted to the fixed electrode structures 110 and 120, a potential is alternatively changed to enable the vibrating film 130 to generate vibration due to difference potentials on two sides thereof, and thereby generating corresponding sound. However, the above configuration needs to enhance the sound-pressure output, so an additional power element is required to work together with the driving process. In this manner, not only the apparatus has a large volume, but also relatively more elements are used, and the cost is also relatively high. In addition, the fixing structure 140 must fix the fixed electrode structures 110 and 120 and the vibrating film 130, so the electro-acoustic transducer structure cannot achieve the flexible characteristics.

SUMMARY OF THE INVENTION

Accordingly, the present invention is directed to a speaker structure, capable of solving problems in the conventional art that, when sound-pressure power is increased, the speaker structure and the driving circuit become too complex, and the metal thin film electrode in the vibrating film structure affects the sound-source signal input and the diversity of the product application design because of oxidation effect. The speaker structure of the present invention has a simple construction, and capable of matching with the current technology and process, so it is suitable for mass production.

In an embodiment, the speaker structure provided by the present invention includes a single electret vibrating film structure, a single metal electrode having a plurality of holes, and a frame supporting member. The electret vibrating film structure is formed by a single electret film layer, a metal thin film electrode, and an isolation layer stacked together, in which the metal thin film electrode is located between the electret film layer and the isolation layer. The frame supporting member is located between the electret vibrating film structure and the metal electrode, so as to form a space for the vibration of the electret vibrating film structure.

In an embodiment of the speaker structure, the speaker structure further includes a plurality of supporting members disposed between the electret vibrating film structure and the metal electrode, for maintaining a distance between the electret vibrating film structure and the metal electrode.

In an embodiment of the speaker structure, the electret vibrating film structure, the metal electrode, and the frame supporting member are made of a material having flexible and transparent characteristics, so as to enable the speaker structure to have the flexible characteristics.

In an embodiment, the speaker structure provided by the present invention includes a single electret vibrating film structure, a metal electrode having a plurality of holes, and a frame supporting member. The electret vibrating film structure is formed by the electret film layer and a conductive electrode layer made of an oxide material, in which the conductive electrode layer is located on one side surface of the electret film layer. The frame supporting member is located between the electret vibrating film structure and the metal electrode, for forming a space for the vibration of the electret vibrating film structure.

In an embodiment of the speaker structure, the speaker structure further includes a plurality of supporting members disposed between the electret vibrating film structure and the metal electrode, for maintaining a distance between the electret vibrating film structure and the metal electrode.

In an embodiment of the speaker structure, the electret vibrating film structure, the metal electrode, and the frame supporting member are made of a material having flexible and transparent characteristics, so as to enable the speaker structure to have the flexible characteristics.

In order to make the aforementioned and other objects, features and advantages of the present invention comprehensible, embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
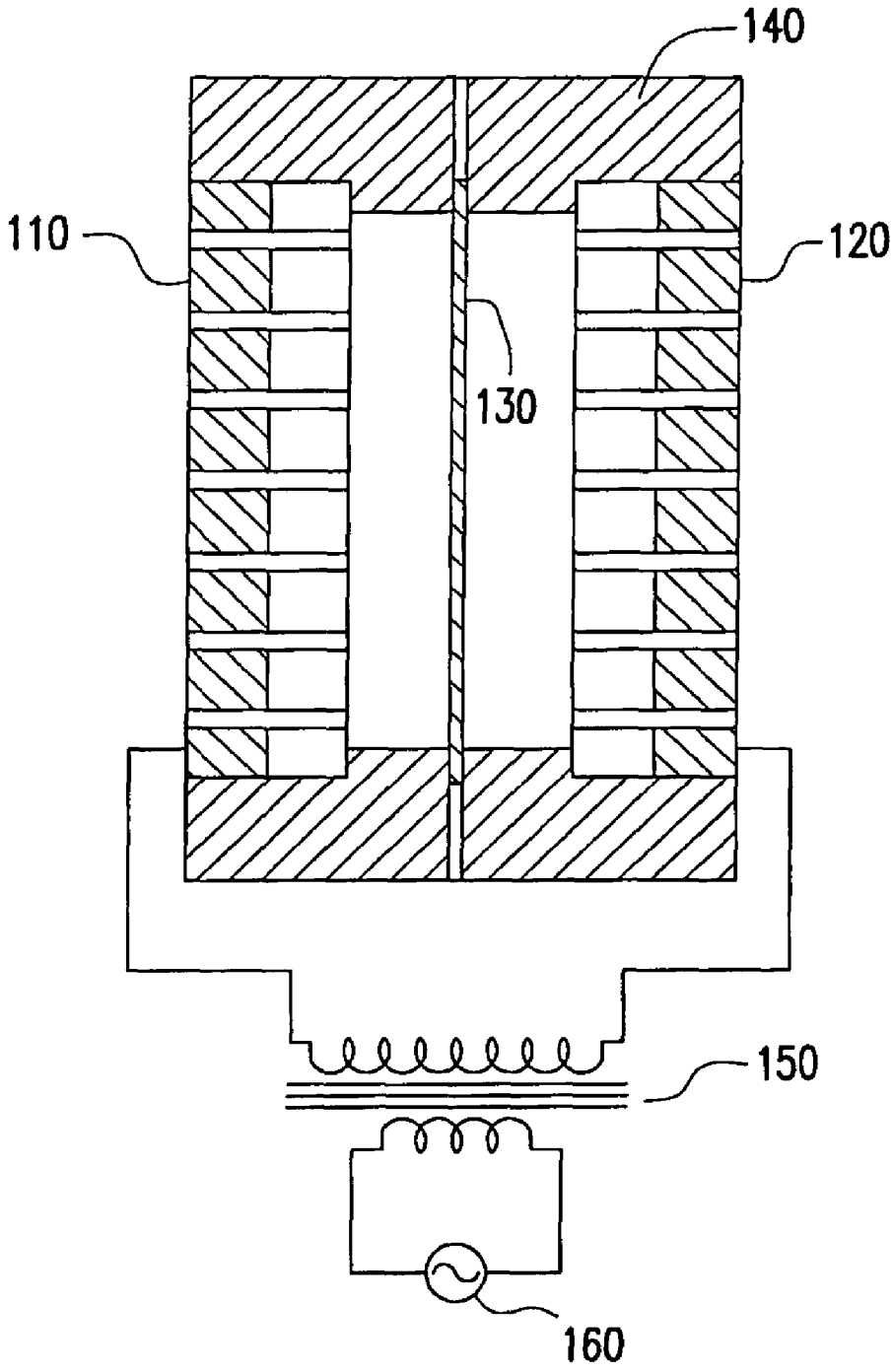
FIG. 1 (PRIOR ART)
FIG. 1 is a schematic view of a conventional speaker unit.

The present invention provides a speaker structure, capable of solving problems in the conventional art that, when sound-pressure power is increased, the speaker structure and the driving circuit become too complex, and the metal thin film electrode in the vibrating film structure affects the sound-source signal input and the diversity of the product application design because of oxidation effect. The speaker structure of the present invention has a simple construction, and capable of matching with the current technology and process, so it is suitable for mass production.

The present invention provides a speaker structure. Through using charge characteristics and electrostatic force effect in the electret material, once the electret vibrating-film is stimulated by an external voltage, the vibrating-film surface generates deformation, so as to drive the air around the vibrating film to generate sounds. As known from the electrostatic force formula and energy laws that, the force applied on the vibrating film equals to the capacitance value of the whole speaker multiplied by the intensity of the internal electric field and the externally-input sound voltage signal, and the larger the force applied on the electret vibrating film is, the louder the output sound is.

According to Coulomb's Law, a product of charges of two charged objects is directly proportional to the electrostatic force interacted there-between, and inversely proportional to a square of the distance between the two objects. If both the two charges are positive or negative, the objects are repelled by repulsive electrostatic force. If one of the charges is positive, and the other is negative, the objectives are attracted by attractive electrostatic force.

The present invention provides a speaker unit having an electret vibrating film with millimicron or nano/micro nanopores, and the structure is formed by a single metal electrode having a plurality of holes and a charged electret vibrating film structure. The electret vibrating film structure is formed by an electret film layer, a conductive electrode formed by an ultra-thin metal electrode layer, and an insulation layer. In another embodiment, the electret vibrating film structure may also be formed by an electret film layer and a conductive electrode layer that is an oxide itself. When the electret vibrating film structure is formed by the ultra-thin metal electrode layer and the insulation layer, a hole must be pre-formed on the isolation layer, for connecting to signals.

The single metal electrode having the plurality of holes may be made of a metal material. In an embodiment, it may also be formed by plating a metal thin film layer on an elastic material, for example, paper or ultra-thin non-conductive material.

The metal electrode having the plurality of holes and the conductive electrode of the electret vibrating film structure are respectively applied with positive and negative voltages form the sound-source signal. According to Coulomb's Law, the electret film layer is forced by an attractive and a repulsive electrostatic force at the same time, and the electrostatic force formula about the force applied to the vibrating-film unit in each unit area can be represented by Formula 1, $$p = \frac{2V_{in}Ve\varepsilon_0\left(\frac{1}{S_a} + \frac{\varepsilon_e}{S_e}\right)\varepsilon_e S_e}{(S_e + \varepsilon_e S_a)^2}. \quad \text{(Formula 1)}$$

In Formula 1, the permittivity of vacuum$\in_0$=8.85*10-12 F/m, an electret dielectric constant is $\in_e$, an electret thickness is $S_e$, an air layer thickness is $S_a$, an input signal voltage is $V_{in}$, an electret voltage is $V_e$, and the force applied on the vibrating-film in unit area is P. As known from Formula 1 that, the electrostatic force is directly proportional to the product of the bias and the audio voltage, and is inversely proportional to the distance between the metal electrode having the plurality of holes and the electret vibrating film structure. Therefore, if under the same distance, the electrostatic speaker can provide high ferro-electricity, and can achieve the required electrostatic force with a relatively low audio AC voltage.

The present invention uses millimicron or nano/micro electret film layer materials to provide a ferroelectric amount of over hundreds of volts. According to the above electrostatic formula, the audio voltage may be reduced to tens of volts, so as to improve the practicality of the speaker of the present invention.

As for the conductive electrode of the electret vibrating film structure, if a metal electrode is adopted, in order to not influence the tension and vibration effects of the electret film layer, it may be an ultra-thin metal thin film electrode, and the thickness of the defined "ultra-thin" herein is between about 0.02 μm (micrometer) and 0.8 mm (millimeter), and the more desirable thickness is between 0.02 μm and 0.4 mm. In an embodiment, the thickness is approximately 0.3 μm. Considering that the ultra-thin metal thin film electrode may be oxidized into a total insulator since it is exposed in the open air when being used and accordingly affects the input of the sound-source signal, an isolation layer is fabricated on a metal thin film electrode (performing a sound-source signal input end) after the metal thin film electrode is fabricated on one side of the electret.

As for the conductive electrode of the electret vibrating film structure, if the conductive electrode itself is selected to be made of an oxide conductive material, a light-transmissive conductive material may be adopted, for example, one of indium tin oxide (ITO), indium zinc oxide (IZO), and aluminum zinc oxide (AZO).

The speaker unit of the present invention may be made of a flexible material, or made of a transparent material, such that the application design diversity is increased, and thus forming a soft flexible speaker.

In the present invention, the speaker structure adopts the electret vibrating-film material having micro meter or nano/micro holes, so the audio voltage for driving the speaker unit may be reduced by several volts to tens of volts, so as to improve the practicability of the speaker of the present invention. The metal thin film electrode has been processed directed to the oxidation problem, so the sound-source signal input is not affected. Through the selection of the materials for the speaker unit, the flexibility for the operation design of the speaker unit may be improved.

In addition, the speaker structure according to the present invention is formed by a single metal electrode and a single charged electret vibrating film structure, so that it has a simple construction, and capable of matching with the current technology and process, so it is suitable for mass production.

Figure 2:
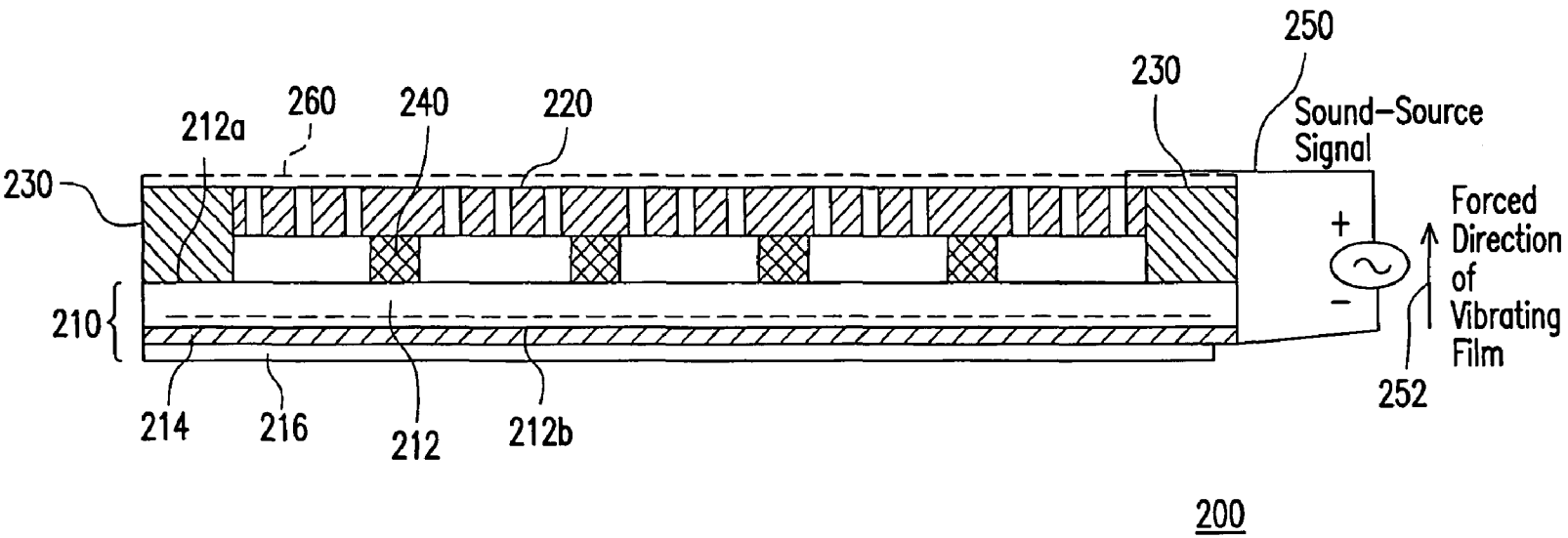
FIG. 2 is a schematic view of a speaker structure according to an embodiment of the present invention.

Here, the speaker structure provided in the present invention is illustrated below through a specific embodiment of the present invention. Referring to FIG. 2, the speaker structure 200 includes an electret vibrating film structure 210, a metal electrode 220 having a plurality of holes, a frame supporting member 230, and a plurality of supporting members 240 located between the metal electrode 220 and the electret vibrating film structure 210. The electret vibrating film structure 210 includes an electret film layer 212, a metal thin film electrode 214, and an isolation layer 216, in which one side surface 212*a* of the electret film layer 212 is connected to the frame supporting member 230 and the supporting members 240, and the other side surface 212*b* is electrically connected to the metal thin film electrode 214. The isolation layer 216 is formed on the other side of the metal thin film electrode 214 facing the side surface 212*b* of the electret film layer 212.

The metal electrode 220 having the plurality of holes may be formed by a metal material. In an embodiment, it may also be formed by plating a metal thin film layer on an elastic material, for example, paper or ultra-thin non-conductive material.

The material of the electret film layer 212 may be selected to be a dielectric material that is capable of maintaining the static charges for a long time after being electrized, and capable of generating ferroelectric effect upon being charged, so it is called an electret film layer. The electret film layer 212 may be a vibrating-film made of a single-layered or multi-layered dielectric material, and the dielectric material may be, for example, fluorinated ethylene-propylene copolymer (FEP), polytetrafluoroethylene (PTFE), polyvinylidene fluoride (PVDF), some fluorine polymer, and other suitable materials. The dielectric material includes pores with micrometer or nano/micro apertures. The electret vibrating film is made of a dielectric material after being electrized and it is capable of maintaining static charges and piezoelectricity for a long time, and has nano/micro pores therein to increase the light transmittance and piezoelectricity, and thus, upon being corona charged, dipolar charges are generated within the material, so as to generate the ferroelectric effect.

In order not to affect the tension and vibration effects of the electret vibrating film structure 210, the metal thin film electrode 214 may be an ultra-thin metal thin film electrode. The thickness of the defined "ultra-thin" herein is between about 0.2 μm and 0.8 mm, and the thickness is more desirably between about 0.2 μm and 0.4 mm in an embodiment, which may be approximately 0.3 μm. In addition, the reason for forming the isolation layer 216 on the external surface of the metal thin film electrode 214 lies in that, the oxidation problem may occur to the ultra-thin metal thin film electrode 214 if it is exposed in the open air when being used, and thus affecting the quality of the speaker unit. Therefore, after the metal thin film electrode 214 is fabricated, the isolation layer 216 is continuously fabricated on the metal thin film electrode 214, but it is necessary to reserve the input position of the sound-source signal 250.

The electret film layer 212 fully injected with negative charges is set as an example for illustration. The input sound-source signal 250 is respectively connected to the metal electrode 220 having the plurality of holes and the metal thin film electrode 214. When the input sound-source signal 250 is a positive voltage, it generates an attractive force with the negative charges of the electret vibrating film on the speaker unit. When the sound-source signal 250 is a negative voltage, it generates an exclusive force with the positive charges on the unit, so as to cause the moving direction of the electret vibrating film structure 210 as that shown by the forced direction 252 of the vibrating film in FIG. 2.

On the contrary, when the voltage-phase input of the sound-source signal 250 is changed, similarly the positive voltage generates an attractive force with the negative charges of the electret vibrating film on the speaker unit, the negative voltage generates an repulsive force with the positive charge on the unit, and the electret vibrating film structure 210 moves towards an opposite direction. When the electret vibrating film 100 moves towards different directions, it generates sound output by means of contracting the around air.

As for the speaker structure in this embodiment, considering the selection of materials, especially the electret vibrating film structure 210, the metal electrode 220 having the plurality of holes, and the frame supporting member 230 may be made of a flexible material or a transparent material, so as to increase the designing diversity, and to form a soft flexible speaker.

As for the speaker structure 200 in this embodiment, as shown in the drawing, although the heights of both the metal electrode 220 and the supporting members 240 are the same as that of the frame supporting member 230, in different embodiments, the heights of the metal electrode 220 and the frame supporting member 230 may be adjusted depending upon different designing requirements, and the height of the supporting members 240 may be adjusted according to different requirements, here, which is not intended to limit this embodiment.

As for the speaker structure 200 in this embodiment, a thin film 260 with air-permeable and water-proofing characteristics may be wrapped on one or two sides thereof, for example, GORE-TEX thin film made of expanded PTFE (ePTFE) material, which can prevent influences caused by water and oxidation that may result in the leakage of the charges of the electret film layer 212 and thus affecting the ferroelectric effect.

Figure 3:
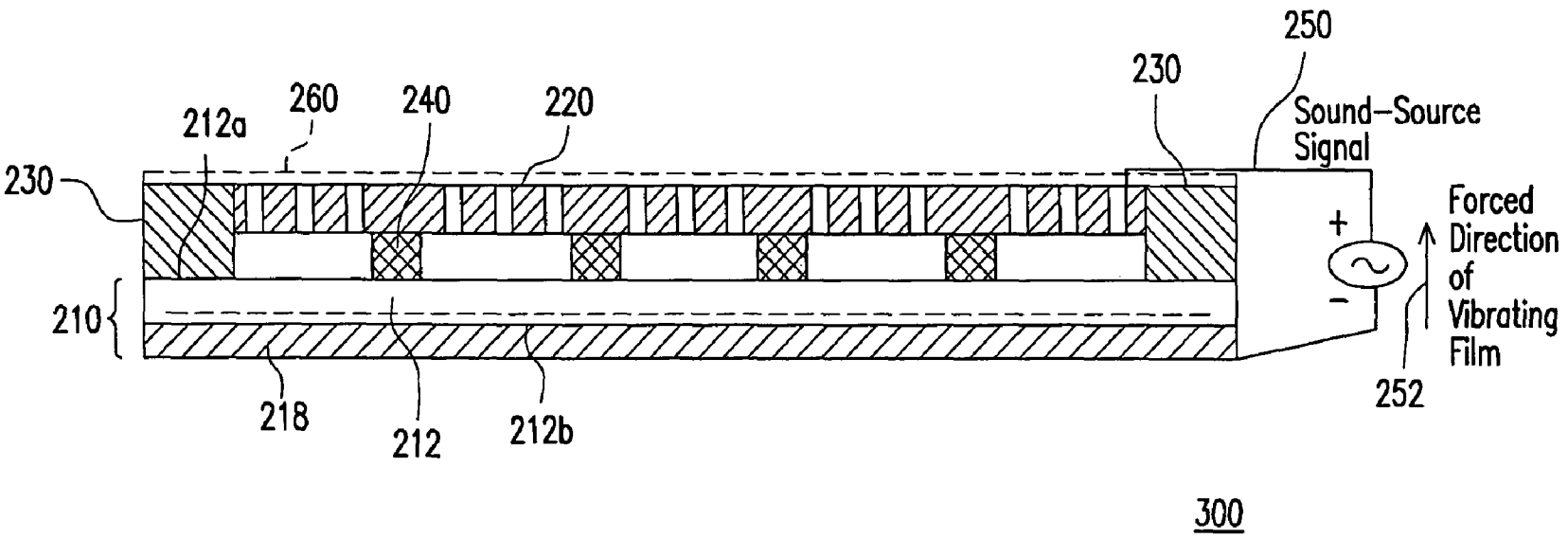
FIG. 3 is a schematic view of another speaker structure according to an embodiment of the present invention.

Another embodiment of the speaker structure provided by the present invention is shown in FIG. 3, in which the same parts as those in FIG. 2 are marked by the same numerals. A speaker structure 300 as shown in FIG. 3 includes an electret vibrating film structure 210, a metal electrode 220 having a plurality of holes, a frame supporting member 230, and a plurality of supporting members 240 located between the metal electrode 220 and the electret vibrating film structure 210. The electret vibrating film structure 210 includes an electret film layer 212 and an oxide conductive layer 218. One side surface 212*a* of the electret film layer 212 is connected to the frame supporting member 230 and the supporting members 240, and the other side surface 212*b* is electrically connected to the oxide conductive layer 218.

The difference from FIG. 2 lies in that the metal thin film electrode 214 of FIG. 2 is replaced by the oxide conductive layer 218 in FIG. 3. The oxide conductive layer 218 may be made of one of ITO, IZO, and AZO.

To sum up, the present invention is capable of solving the problem in the conventional art that the circuit and the structure of the conventional electrostatic speaker are too complex, and capable of preventing the metal thin film electrode from affecting the sound-source signal input due to being oxidized, and thus having flexibility to cater to the designing changes, so as to satisfy the requirements of the soft electronics.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A speaker structure, comprising:

an electret vibrating film structure, comprising an electret film layer, a metal film electrode, and an isolation layer stacked together, wherein the metal film electrode is located between a first side surface of the electret film layer and the isolation layer;

a metal electrode, having a plurality of holes; and a plurality of supporting members, disposed between the electret vibrating film structure and the metal electrode, wherein a second side surface of the electret film layer faces the plurality of supporting members, the first side surface and the second side surface are located on two opp osite sides of the electret film layer, and the supporting members maintains a distance between the electret vibrating film structure and the metal electrode and forms a space between the electret vibrating film structure and the metal electrode for the vibration of the electret vibrating film structure.

2. The speaker structure as claimed in claim 1, wherein the electret film layer is made of a material having a plurality of nano/micro pores.

3. The speaker structure as claimed in claim 1, wherein the electret film layer is made of a material having a plurality of micrometer pores.

4. The speaker structure as claimed in claim 1, wherein the electret film layer is made of a material having ferroelectric characteristics.

5. The speaker structure as claimed in claim 4, wherein the electret film layer is made of a dielectric material.

6. The speaker structure as claimed in claim 5, wherein the dielectric material is selected from a group consisting of fluorinated ethylene-propylene copolymer (FEP), polytetrafluoroethylene (PTFE), polyvinylidene fluoride (PVDF), and some fluorine polymer, or any combination thereof.

7. The speaker structure as claimed in claim 1, wherein the metal film electrode has a thickness between 0.02 μm (micrometer) and 0.8 mm (millimeter).

8. The speaker structure as claimed in claim 1, wherein the metal film electrode has a thickness between 0.02 μm (micrometer) and 0.4 mm (millimeter).

9. The speaker structure as claimed in claim 1, wherein the isolation layer has a pore for a sound-source signal to be connected to the metal film electrode.

10. The speaker structure as claimed in claim 1, further comprising a frame supporting member, located between the electret vibrating film structure and the metal electrode and surrounding the plurality of supporting members.

11. The speaker structure as claimed in claim 10, wherein the electret vibrating film structure, the metal electrode, and the frame supporting member are made of a material with flexible and transparent characteristics, so as to enable the speaker structure to have flexible characteristics.

12. The speaker structure as claimed in claim 1, further comprising a thin film, for wrapping the electret vibrating film structure and the metal electrode, wherein the thin film is made of a material with air permeable and water proofing characteristics.

13. The speaker structure as claimed in claim 12, wherein the material with air permeable and water proofing characteristics comprises expanded polytetrafluoroethylene (ePTFE) material.

14. The speaker structure as claimed in claim 1, wherein the metal electrode having a plurality of holes is made of a metal material layer.

15. The speaker structure as claimed in claim 1, wherein the metal electrode having a plurality of holes is formed by electroplating a metal material layer on a piece of paper.

16. A speaker structure, comprising:

an electret vibrating film structure, comprising an electret film layer and a conductive electrode layer, the conductive electrode layer is formed by an oxide material, wherein the conductive electrode layer is located on a first side surface of the electret film layer;

a metal electrode having a plurality of holes; and a plurality of supporting members, disposed between the electret vibrating film structure and the metal electrode, wherein a second side surface of the electret film layer faces the plurality of supporting members, the first side surface and the second side surface are located on two opposite sides of the electret film layer, and the supporting members maintains a distance between the electret vibrating film structure and the metal electrode and forms a space between the electret vibrating film structure and the metal electrode for the vibration of the electret vibrating film structure.

17. The speaker structure as claimed in claim 16, wherein the electret film layer is made of a material having a plurality of nano/micro pores.

18. The speaker structure as claimed in claim 16, wherein the electret film layer is made of a material having a plurality of micrometer pores.

19. The speaker structure as claimed in claim 16, wherein the electret film layer is made of a material having ferroelectric characteristics.

20. The speaker structure as claimed in claim 19, wherein the electret film layer material is made of a dielectric material.

21. The speaker structure as claimed in claim 20, wherein the dielectric material is selected from a group consisting of FEP, PTFE, PVDF, and some fluorine polymer or any combination thereof.

22. The speaker structure as claimed in claim 16, further comprising a frame supporting member, located between the electret vibrating film structure and the metal electrode and surrounding the plurality of supporting members.

23. The speaker structure as claimed in claim 22, wherein the electret vibrating film structure, the metal electrode, and the frame supporting member are made of a material having flexible and transparent characteristics, so as to enable the speaker structure to have the flexible characteristics.

24. The speaker structure as claimed in claim 16, wherein the conductive electrode layer made of the oxide material is made of a transparent oxide material with conductive characteristics.

25. The speaker structure as claimed in claim 24, wherein the material for forming the conductive electrode layer is selected from a group consisting of indium tin oxide (ITO), indium zinc oxide (IZO), aluminum zinc oxide (AZO), or any combination thereof.

26. The speaker structure as claimed in claim 16, further comprising a thin film, for wrapping the electret vibrating film structure and the metal electrode, wherein the thin film is made of a material with air permeable and water proofing characteristics.

27. The speaker structure as claimed in claim 26, wherein the material with air permeable and water proofing characteristics comprises ePTFE material.

* * * * *